US005507125A

United States Patent [19]

McClure

[11] Patent Number: 5,507,125

[45] Date of Patent: Apr. 16, 1996

[54] CEILING PANEL WITH STIFFLY FLEXIBLE EDGES, AND CEILING

[76] Inventor: Roberta McClure, 8620 Gravois, St. Louis, Mo. 63123

[21] Appl. No.: 261,187

[22] Filed: Jun. 13, 1994

[51] Int. Cl.[6] ..... E04B 9/28

[52] U.S. Cl. ..... 52/506.07; 52/506.09; 52/762; 52/763; 52/309.1

[58] Field of Search ..... 52/506.07, 506.08, 52/506.09, 509, 510, 762, 763, 773, 774, 778, 309.1, 309.7

[56] References Cited

U.S. PATENT DOCUMENTS

| | | | |
|---|---|---|---|
| 3,834,106 | 9/1974 | Astedt et al. . | |
| 4,189,893 | 2/1980 | Kuhr | 52/506.07 |
| 4,490,957 | 1/1985 | Bumpus et al. | 52/506.07 |
| 5,253,463 | 10/1993 | Witmyer | 52/506.07 |

FOREIGN PATENT DOCUMENTS

| | | | |
|---|---|---|---|
| 213607 | 2/1961 | Austria | 52/506.07 |
| 1021171 | 2/1953 | France | 52/506.07 |
| 632610 | 7/1949 | United Kingdom | 52/506.07 |

*Primary Examiner*—Carl D. Friedman

*Assistant Examiner*—Christopher Todd Kent

*Attorney, Agent, or Firm*—Polster, Lieder, Woodruff & Lucchesi

[57] ABSTRACT

A plastic ceiling panel is mounted in a grid of T-rails. The ceiling panel is shaped complementarily to the space defined by facing edges of the T-rails, and includes a central web and sidewalls extending upwardly from the central web. The sidewalls include a lower part that projects halfway across a lower surface of the T-rail, to butt against the corresponding lower part of contiguous panels in spaces surrounding the first panel, so as to give the impression of a continuous, uninterrupted ceiling. The sidewalls are stiffly flexible and are provided with a channel into which the facing edge of each of the T-rails forming the grid space in which the ceiling panel is seated, is received. In installing the ceiling panels, the sidewalls are flexed inwardly enough to permit the wall defining the upper surface of the channel to clear the edge of the contiguous ledge of the T-rail, and released to permit the wall to move outwardly and permit the channel wall to over-lie the ledge of the T-rail sufficiently to support the panel in place. A tab with a hook on its free edge is integral with the panel, and bendable to extend over the vertical stem of the T-rail to insure that the T-rail and panel do not move unacceptably relative to one another.

15 Claims, 3 Drawing Sheets

CEILING PANEL WITH STIFFLY FLEXIBLE EDGES, AND CEILING

BACKGROUND OF THE INVENTION

It is conventional to support ceiling panels in a grid of T-bars, generally spaced on 2' centers. The ceiling panels are installed by turning them diagonally, pushing them up into the space above the plane defined by the horizontal elements of the T-rails, turning them to orient them properly, and dropping them onto the upper surface of the horizontal ledge of the T-rail. The ceiling panels have sometimes been provided with an off-set or rabbet along each edge, to facilitate their orientation and to make them either flush with the lower surface of the T-rail or even to project a short distance below that T-rail surface. In any event, the T-rails themselves are still in evidence, and the decorative effect is limited. It has not been possible with this type of ceiling to give the effect of an unbroken expanse.

Attempts have been made to provide ceilings made up of panels that still gave the impression of continuous surface, but they have involved metal panels or metal frames for panels, and have been somewhat complicated to make and use. See, for example, U.S. Pat. Nos. 4,760,677 and 4,291,783.

One of the objects of this invention is to provide a plastic panel constructed to permit the installation of a multiplicity of such panels in a grid of rails, in which contiguous panels abut so as to obscure the joint between them.

Other objects will become apparent to those skilled in the art in the light of the following description and accompanying drawings.

SUMMARY OF THE INVENTION

In accordance with this invention, generally stated, a plastic ceiling panel is provided for use with a grid of rails, the rails having a horizontal element with upper and lower surfaces and inwardly facing edges defining a space lying substantially in a plan. The panel comprises a central web and sidewalls integral with and framing the central web. The sidewalls extend along the rail edges and have a lower part extending beneath a part of the rail element lower surface, an upper part extending over a part of the rail element upper surface, and an intermediate part extending around the rail element edge. The sidewall is stiffly inwardly flexible. Means are provided for permitting the upper part of the side rails to be flexed to a position at which the upper part clears the edge of the rails and when released, to move outwardly over that part of the rail element so as to rest upon the upper surface of the rail element, and support the panel.

In the preferred embodiment, the rails are T-rails, and the intermediate part of the sidewalls includes a riser, an inward extending tread wall, and a bottom wall bridging between an inner edge of the tread wall and an inner edge of the upper wall to define a rail-edge receiving channel. In this embodiment, the ceiling panel upper wall has at its outer edge an up-turned lip. The means for permitting flexture of the panel sidewall include horizontal slots in corners of the panel, immediately below the lip.

In one embodiment, the upper wall has integral with it a tab with a hook on it and integral with it, which extends over and engages a vertical stem of the T-rail.

In still another embodiment, the means for permitting flexure includes, in addition to the horizontal slot, a vertical base at two diagonally disposed corners of a rectangular panel. In yet another embodiment, the upper wall, up-turned lip, inward tread wall, and bridging bottom wall all end short of at least two diagonally opposite corners of a rectangular panel.

IN THE DRAWINGS

DESCRIPTION OF THE PREFERRED EMBODIMENTS

Figure 9:
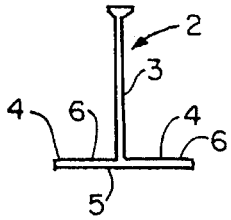
FIG. 9 is an end elevation of a T-rail support.

Referring now to the drawings, and particularly to FIGS. 1, 2, and 4–7A, reference numeral 1 indicates a ceiling supported by a grid 8 of T-rails 2. The T-rails 2 are conventional, with vertical stems 3 and horizontal ledges 4 extending equidistantly from the lower edge of the stems, as shown in FIG. 9. The ledges define a continuous lower surface 5 and upper surfaces 6 that are separated by the vertical stem of the T-rail. In the grid 8 shown, the T-rails define square spaces, in which panels 9 are mounted.

Each of the panels 9 has a central web 10 that extends to and along the center line of the lower surface of the T-rail. Sidewalls 12 of the web extend upwardly from the web and frame the web. The sidewalls include a lower, butting part 14, an upper wall 16 around which an upturned lip 17 extends with a free edge directed outwardly. The upper wall 16 has a lower surface 18. Between the lower part 14 and the upper wall 16 is an intermediate part, made up of a riser 20, an inward tread wall 21 and a bridging bottom wall 23, U-shaped in side elevation, defining with the lower surface 18 of the upper wall and an upper surface of the inward tread wall, a channel 24.

Figure 2:
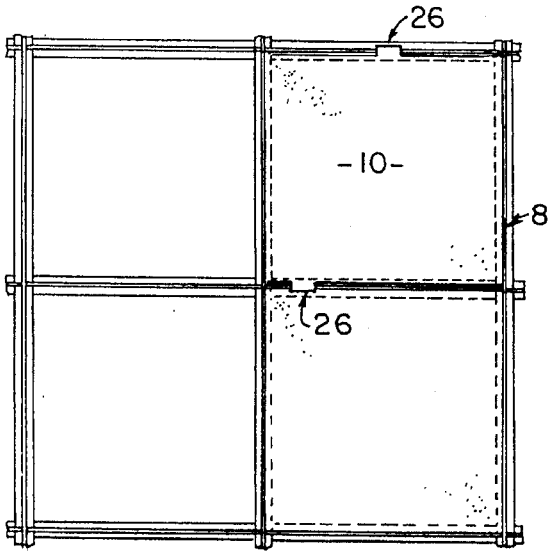
FIG. 2 is a top plan view of the grid shown in FIG. 1, in which two ceiling panels of one embodiment of this invention are mounted, one of which is provided with tabs.
Figure 1:
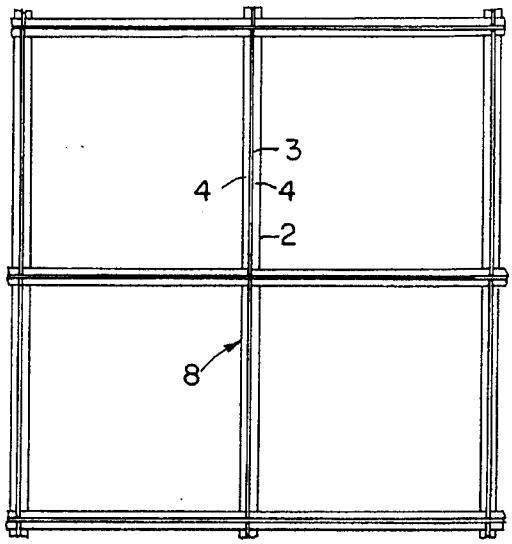
FIG. 1 is a top plan view of a portion of a ceiling grid.
Figure 10:
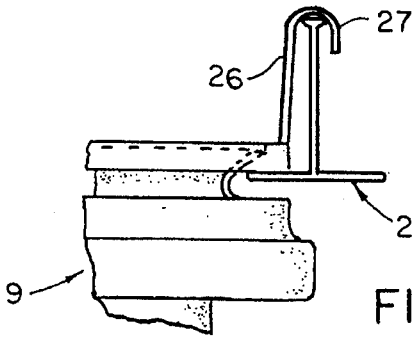
FIG. 10 is a fragmentary end elevation of a panel mounted on a T-rail.

In the embodiment shown in FIG. 2, in the upper right section, the upper wall 16 has integral with it a tab 26, with an upwardly extending hook part 27. The tab 26 can be bent up to cause the hook 27 to extend over and around the top edge of the stem 3 of the T-rail, as shown in FIG. 10.

In the embodiment shown in FIGS. 4–7A, the upper surface of the panel web 10 is tegular or inverted coffered. At the four corners of the panel, the tread wall 21, upper wall 16, and bottom wall 23 end short of the corners, as shown particularly in FIGS. 4 and 7A. The riser and lip meet, and extend to each corner, and a slot 32 is formed in the corner, parallel with and of a vertical width commensurate with the height of the channel 24. This provides sufficient flexibility to the sidewalls and upper wall to permit installation of the panels.

Figure 7A:
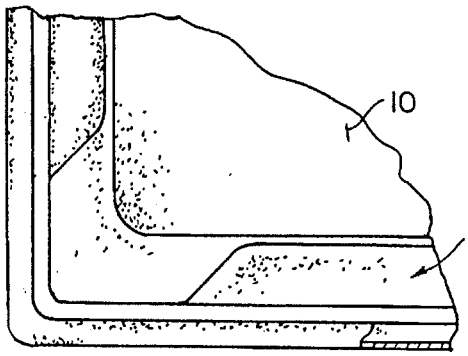
FIG. 7A is a fragmentary top plan view of a corner of the panel shown in FIGS. 4 through 6.
Figure 7B:
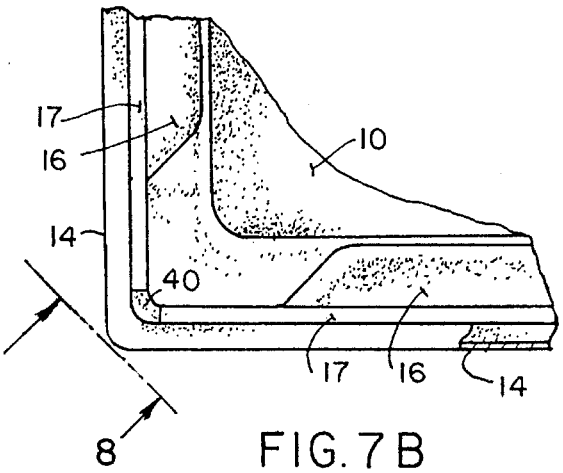
FIG. 7B is a top plan view corresponding to the view shown in FIG. 7A, showing another embodiment of ceiling panel.
Figure 8A:
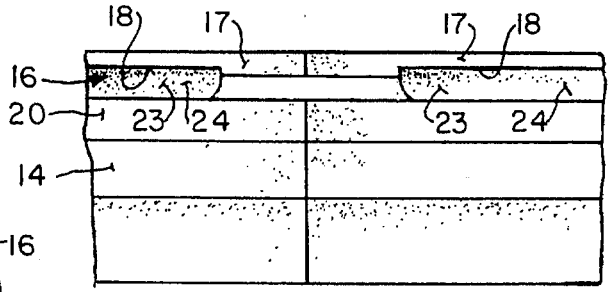
FIG. 8A is a view in side elevation in the direction shown as 8—8 in FIG. 7B, of the panel shown in FIG. 7A.
Figure 8B:
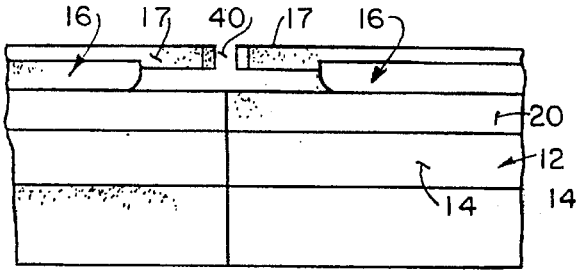
FIG. 8B is a view in side elevation taken along the line 8—8 of FIG. 7B.

In order to increase the amount of flexibility, the arrangement shown in FIGS. 7B and 8B can be employed, where a vertical gap 40 is made between the upper surface of the lip 17 and the slot 32 on at least two, diagonally opposite corners.

Figure 7C:
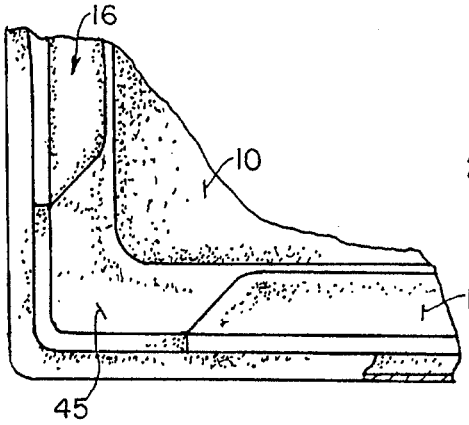
FIG. 7C is a top plan view corresponding to the views shown in FIGS. 7A and 7B, of yet another embodiment of the panel of this invention.
Figure 8C:
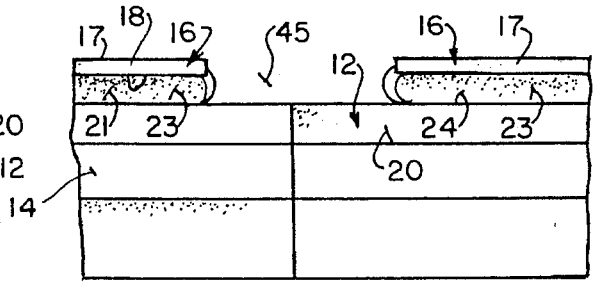
FIG. 8C is a view in side elevation, in the direction corresponding to the line 8—8 of FIG. 7B of the panel shown in FIG. 7C.

In a third embodiment, the upper wall including the lip, tread wall, and bridging bottom wall all terminate short of the corner, as shown in FIGS. 7C and 8C.

Figure 3:
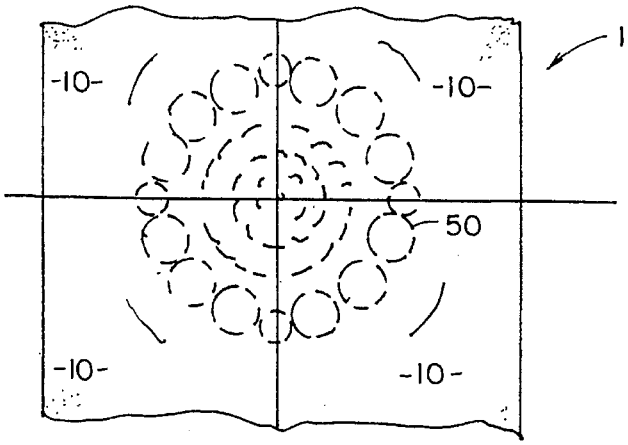
FIG. 3 is a plan view looking up of a portion of four ceiling panels of this invention installed, indicating how a large ornamental design can easily be created.
Figure 6:
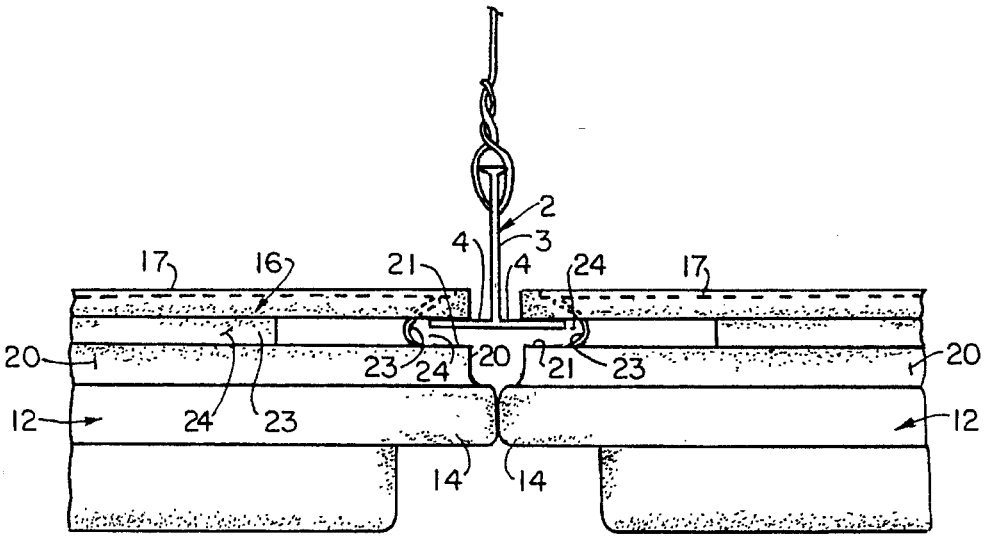
FIG. 6 is a fragmentary view, somewhat enlarged, in side elevation of the panels shown in FIGS. 4 and 5.

The risers of contiguous panels butt one another, leaving no space between them, as illustrated in FIG. 6. This provides an unbroken expansive ceiling, and permits the provision of embossed or debossed decorative designs which span 4, 8, 12, or more panels. Such a design is suggested in FIG. 3, indicated by the reference numeral 50.

Figure 4:
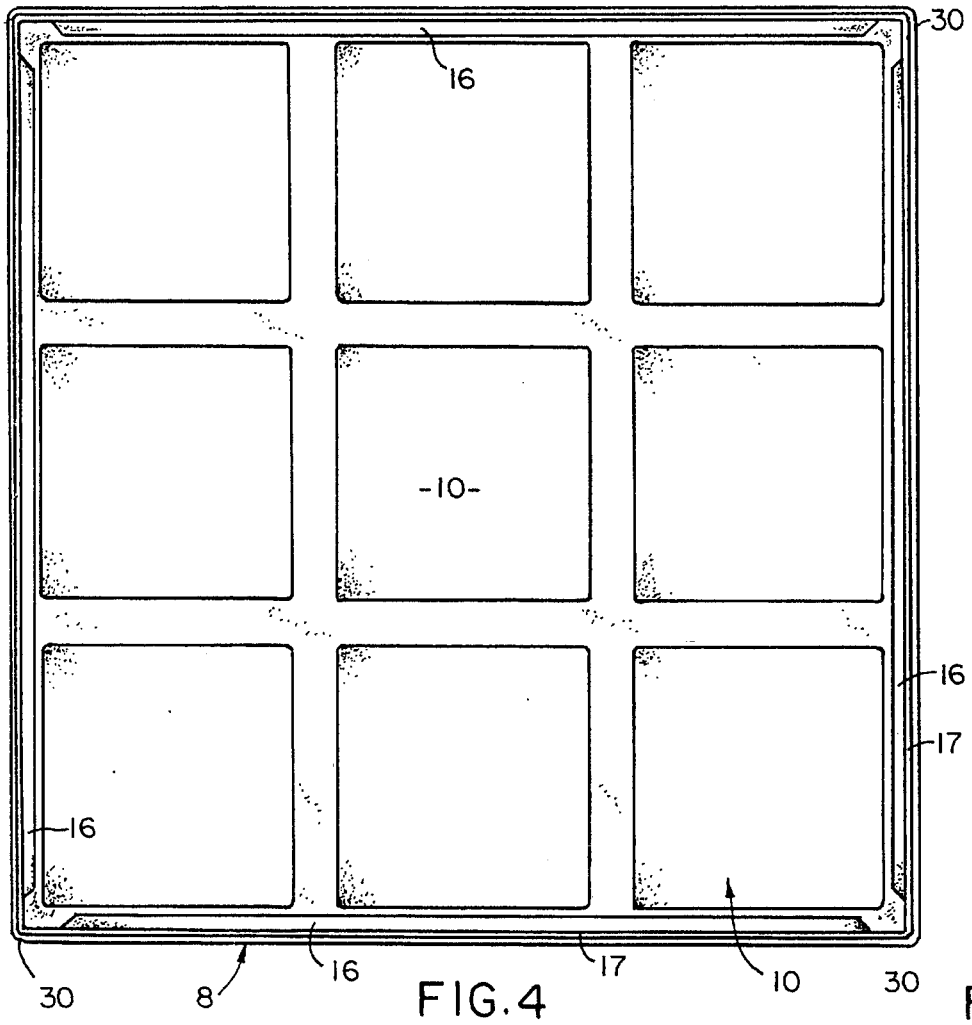
FIG. 4 is a top plan view of another embodiment of ceiling panel of this invention.
Figure 5:
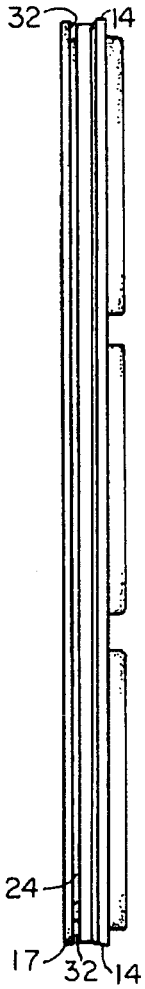
FIG. 5 is a view in side elevation of the panel shown in FIG. 4.

In installing panels of this invention, the sidewalls, which are stiffly flexible, are flexed inwardly along two sides and introduced at a slight slant, with the unflexed sides spaced from their contiguous ledges. The sides that have been introduced are then released and at least one of the sidewalls perpendicular to the walls that have been inserted is flexed inwardly and the panel slid into position and raised to permit the lip of the sidewall to clear the ledge of the T-rail to which it is to be mounted. The center panel is self-supporting, and if desired, can be ribbed or otherwise reinforced on its upper side, or in the form of a suitable design, on its underside, or both. The inverted coffered design of the panel shown in FIG. 4 is an example. If a ceiling does not accommodate a full length of a grid along one edge, for example, the panel can be cut, and supported on three sides. The fact that the lower part of the sidewall has substantial height provides a finished appearance along the cut edge of the panel that abuts the wall.

Numerous variations in the construction and design of the ceiling panel and ceiling of this invention, within the scope of the appended claims will occur to those skilled in the art in the light of the foregoing disclosure. Merely by way of example, cross members of the grid may be made in the form of splines, essentially T-rails without the vertical stem. The supporting grid can take other forms, even including an up-turned lip or rim at the outer edges of the horizontal surfaces, with a corresponding accommodation in the size or configuration of the channel 24. The tabs 26 can be positioned as desired along the length of the panels, but staggering them largely precludes the problem of interference between tabs of successive panels. The tabs may be provided on all four sides, and only bent up into position on two, so that, in creating a design such as the one suggested in FIG. 3, the bent tabs on contiguous panels can be oriented in the same direction. The height and sharpness of the lower corner of the lower part 14 of the sidewall of the panel can be varied. These are merely illustrative.

I claim:

1. A plastic ceiling panel for use with a grid of rails, said rails having a horizontal element with upper and lower surfaces and inwardly facing edges defining a space lying substantially in a plane, said panel comprising a central web and sidewalls integral with and flaming said central web, each of said sidewalls being adapted to extend along said rail edges, having a lower part adapted to extend beneath a part of said rail element lower surface, an upper part adapted to extend over a part of said rail element upper surface, and an intermediate part adapted to extend around said rail element edge, said sidewall being stiffly inwardly flexible, and means for permitting the said upper part to be flexed to a position at which said upper part clears said edge and to move outwardly over said part of said rail element.

2. The ceiling panel of claim 1 wherein the space defined by edges of the rails and by said sidewalls is rectangular.

3. The ceiling panel of claim 2 wherein the space and sidewalls define a square.

4. The ceiling panel of claim 1 wherein the lower part of the sidewalls is adapted to extend halfway over the lower surface of said rails, to butt with a contiguous ceiling panel.

5. The ceiling panel of claim 1 wherein the rails are T-rails and the upper part of the sidewalls includes a tab, integral with the sidewall, said tab having a hook part adapted to extend over and to engage a vertical stem of said T-rails.

6. The ceiling panel of claim 1 wherein the intermediate part of the sidewalls comprises a riser, an inward extending tread wall, and a bottom wall bridging between an inner edge of said tread wall and inner edge of said upper wall to define a rail-edge receiving channel.

7. The ceiling panel of claim 6 wherein the upper wall has at its outer edge an up-turned lip.

8. The ceiling panel of claim 7 wherein the upper wall below the lip, the inwardly extending tread wall, and the bridging bottom wall end short of an arris at which the riser and lip meet their contiguous counterparts.

9. The ceiling panel of claim 8 wherein the upper lip of contiguous sides ends short of the arris at at least two corners.

10. The ceiling panel of claim 7 wherein the upper wall, up-turned lip, inward tread wall, and bridging bottom wall all end short of at least two diagonally opposite corners.

11. A ceiling comprising a grid of T-rails defining a muliplicity of 2'×2' openings, said T-rails comprising a vertical stem and horizontal ledges extending an equal distance from either side of said stem and defining a lower T-bar surface and upper ledge surfaces, and plastic ceiling panels mounted in said grid, said ceiling panels comprising a central web and sidewalls integral with and framing said central web squarely, said sidewalls having a lower part extending beneath and halfway across said T-bar lower surface to butt with the lower part of the sidewall of an adjacent panel, an upper part projecting over a portion of a T-bar ledge to support said panel, and an intermediate part extending around an edge of said ledge and bridging between said upper and lower parts, said sidewalls being stiffly flexible, and means for permitting flexure of the said upper part of at least two of said sidewalls that extend perpendicularly to one another to permit the said upper part to clear said ledges edges and to move back over a part of said upper ledge surface.

12. The ceiling of claim 11 wherein said upper part has an up-turned lip at an outer edge, and said means for permitting flexure of said panel sidewall comprise horizontal slots in the four corners of the intermediate part of the sidewall, immediately below said lip.

13. The ceiling of claim 12 wherein said means for permitting flexure of said panel sidewall include vertical interruptions at two, diagonally opposite corners of said sidewall, extending through said lip.

14. The ceiling of claim 11 wherein said side wall intermediate part and said side wall upper part, including said lip, end short of each corner.

15. The ceiling of claim 11 wherein said ceiling panel sidewall upper part has integral with it on two opposite sides, a bendable tab with a hook part adapted to pass over and engage the vertical stem of the T-rail to which the ceiling panel is mounted.

* * * * *